US006546228B2

(12) United States Patent
Motohashi et al.

(10) Patent No.: US 6,546,228 B2
(45) Date of Patent: Apr. 8, 2003

(54) IMAGE FORMING APPARATUS CONVENIENTLY UPGRADABLE TO A DUPLEX IMAGE FORMING APPARATUS

(75) Inventors: Takeshi Motohashi, Kanagawa-Ken (JP); Masashi Takiguchi, Kanagawa-Ken (JP); Hirotaka Hatta, Kanagawa-Ken (JP); Katsuhiro Kosuge, Kanagawa-Ken (JP); Hideyuki Takemoto, Kanagawa-Ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/757,600

(22) Filed: Jan. 11, 2001

(65) Prior Publication Data

US 2001/0012462 A1 Aug. 9, 2001

(30) Foreign Application Priority Data

Jan. 11, 2000 (JP) ..... 2000-003000
Feb. 14, 2000 (JP) ..... 2000-035757
Dec. 22, 2000 (JP) ..... 2000-391209

(51) Int. Cl.[7] ..... G03G 15/00
(52) U.S. Cl. ..... 399/401; 399/124
(58) Field of Search ..... 399/309, 364, 399/124, 401, 402; 355/24; 271/303, 184, 185, 186

(56) References Cited

U.S. PATENT DOCUMENTS 4,875,063 A 10/1989 Idenawa et al.
5,196,897 A * 3/1993 Trask ..... 271/186
5,572,308 A * 11/1996 Suda et al. ..... 162/271
5,708,954 A * 1/1998 Ando et al. ..... 399/401
5,857,137 A * 1/1999 Sakata et al. ..... 271/3.03
5,905,934 A * 5/1999 Koshimizu ..... 271/161
5,923,360 A * 7/1999 Mori ..... 347/262
6,128,463 A * 10/2000 Matsumoto et al. ..... 399/364
6,256,464 B1 * 7/2001 Sumiyoshi ..... 399/364
6,304,739 B1 10/2001 Katsuyama et al.
6,331,004 B1 * 12/2001 Katou et al. ..... 271/301
6,340,157 B1 * 1/2002 Watanabe et al. ..... 271/186

FOREIGN PATENT DOCUMENTS

JP 03013463 A * 1/1991 ..... B65H/85/00
JP 6-110274 4/1994
JP 7-261471 10/1995
JP 10-072174 3/1998

* cited by examiner

*Primary Examiner*—Robert Beatty
(74) *Attorney, Agent, or Firm*—Oblon, Spivak, McClelland, Maier & Neustadt, P.C.

(57) ABSTRACT

An image forming apparatus includes a first sheet path, a first sheet transfer mechanism, an ejection mechanism, a second sheet path, and a sheet flipping mechanism. The first sheet path is in a first side of the image forming apparatus. The first sheet transfer mechanism sends recording sheets from a sheet cassette through the first sheet path. The ejection mechanism switches between an ejection process and a duplex recording process. The second sheet path receives the recording sheet from the ejection mechanism and returns it to the image recording mechanism. The second sheet path is on the other side of the apparatus than the first side in which the first sheet path is arranged. The sheet flipping mechanism flips the recording sheet and has a flipping space in which the recording sheet is flipped without coming outside of the image forming apparatus. The ejection mechanism, the second sheet path, and the sheet flipping mechanism are located in a separate add-on unit. The second sheet path has openable/closable side guides for operator access.

28 Claims, 8 Drawing Sheets

IMAGE FORMING APPARATUS CONVENIENTLY UPGRADABLE TO A DUPLEX IMAGE FORMING APPARATUS

CROSS-REFERENCE TO RELATED APPLICATIONS

This application claims priority to Japanese Patent Application Nos. JPAP2000-003000 filed on Jan. 11, 2000, JPAP2000-035757 filed on Feb. 14, 2000, and JPAP2000-391209 filed on Dec. 22, 2000, in the Japanese Patent Office, the entire contents of which are hereby incorporated by reference.

BACKGROUND OF THE INVENTION

1. Field of the Invention

The present invention relates to an image forming apparatus, and more particularly to an image forming apparatus that can conveniently be upgraded to a duplex image fonning apparatus.

2. Discussion of the Background

An electrophotographic image forming apparatus is widely used in various machines, such as copying machines, laser printers, facsimile machines, etc. In such electrophotographic image forming apparatus, an electrostatic latent image is formed on a photoconductive member and is developed, with toner, into a toner image, which is then transferred and fixed onto a recording sheet made of plain paper. As penetration of the electrophotographic image forming apparatus increases, requirements for a compact size and a light weight are increased.

In order to remain within the scope of the above requirements, various efforts have been made, such as, for example, a length of a sheet transfer path, for transferring a recording sheet inside the apparatus, has been shortened. In addition, an interior layout of the apparatus has been designed for a better machine handling in case of problems, such as a paper jam. For example, a sheet cassette is located at a lower part, fixing and ejection units are located on an upper part, and the above lower and upper parts are connected to each other with a vertical sheet-path. Furthermore, an operation panel is mounted on a front surface of the machine, typically in small-sized and mid-sized machines.

In addition, a requirement for a duplex printing function has recently been increased in connection with a movement of natural resource preservation. To cope with such a requirement, an image forming apparatus, employing the above-mentioned machine design, and which is capable of adopting an add-on duplex unit, has been developed. A published Japanese Unexamined Patent Application, No. 6-110274, described an example of such duplex image forming apparatus, as shown in FIG. 1.

In the duplex image forming apparatus of FIG. 1, a sheet flipping unit 130, for flipping a recording sheet during a duplex image forming process, is mounted on a top and front part of the apparatus. In the front side, the apparatus is provided with a manual sheet insertion guide 140.

In the duplex image forming apparatus of FIG. 1, a recording sheet is transferred from a sheet cassette 141 during a duplex print mode, in which an image print is performed on both surfaces of the recording sheet. The recording sheet is stopped by registration rollers 142 and is restarted in synchronism with the rotation of a photoconductive drum 151. After that, the recording sheet proceeds to a process unit 150 having the photoconductive drum 151.

When a recording sheet is inserted from the inlet of the manual sheet insertion guide 140, the recording sheet also proceeds to the process unit 150, via a manual sheet insertion path 143.

In the process unit 150, the recording sheet is subjected to an image forming process on its front surface and, as a result, the recording sheet has a toner image on the front surface. After that, the toner image is fixed with a heat fixing unit and is transferred upwardly. When a sensor 152 detects the leading edge of the recording sheet, a switch pawl 131 is turned to a position indicated by solid lines in FIG. 1.

When the switch pawl 131 is at this position, the recording sheet is forwarded into the sheet flipping unit 130. More specifically, the recording sheet is transported by a pair of switchback rollers 132 so that the leading edge of the recording sheet is ejected over a stacker 133. When a sensor 134 detects the trailing edge of the recording sheet, the switchback rollers 132 are reverse rotated so that the recording sheet is reverse transferred towards an exit 136 through a sheet path 135 in the sheet flipping unit 130. After that, the recording sheet again proceeds to the process unit 150 via the manual insertion path 143. In the process unit 150, the recording sheet is subjected to the image forming process, but on its back surface this time. As a result, the recording sheet is printed on both front and back surfaces.

After that, the recording sheet is guided to a pair of ejection rollers 137 by the switch pawl 131, which is by now turned to a position indicated by dotted lines. The recording sheet is then ejected with the ejection rollers 137 onto stacker 133.

As another example, a published Japanese Unexamined Patent Application, No. 7-261471, describes an image forming apparatus capable of having an add-on duplex unit. In this example, an opening to an outside is formed in a pair of sheet transfer paths downstream from a fixing unit in a sheet transfer direction. A duplex unit is attached to the image forming apparatus such that a sheet inlet is fit with the above opening. When the recording sheet is flipped, the leading edge of the recording sheet is ejected to an outside from the duplex unit or over an eject tray from the image forming apparatus.

In the above image forming apparatus, the operator is needed to open a front cover to deal with a paper jam or to exchange consumable items, since the apparatus has the design of the front operation panel and the vertical sheet transfer path, as described below. Therefore, if the duplex unit is attached to the front of the apparatus, the duplex unit becomes a severe obstacle and the inside accessibility of the apparatus is decreased.

In addition, a front design of the image forming apparatus would have a relatively large difference between those having the duplex unit and those having none. Accordingly, various components associated with the front design could not be unified and therefore, a consistency of machine model may become difficult.

Furthermore, in the image forming apparatus described in the published Japanese Unexamined Patent Application Nos. 6-110274 and 7-261471, a part of the recording sheet is temporarily ejected outside the apparatus and is reverse transferred during the sheet flipping process for the duplex image forming operation. Accordingly, there is a risk that the recording sheet is accidentally touched or held by anything, such as the operator, when the recording sheet is temporarily ejected outside the apparatus during the duplex image forming operation. As a result, the recording sheet may be jammed inside the apparatus. When the ejected part of the recording sheet touches other recording sheets stacked on the stacker, it is possible that other recording sheets may be pushed away.

SUMMARY OF THE INVENTION

The present invention provides a novel image forming apparatus. In one example, a novel image forming apparatus includes a sheet cassette, a first sheet path, a first sheet transfer mechanism, an image recording mechanism, an ejection mechanism, a second sheet path, and a sheet flipping mechanism. The sheet cassette is configured to contain a plurality of recording sheets. The sheet cassette is located at a lower part of the image forming apparatus. The first sheet path is arranged on a side of the apparatus. The first sheet transfer mechanism is configured to send a recording sheet one by one from the sheet cassette through the first sheet path. The image recording mechanism is configured to perform an image recording process relative to the recording sheet sent by the first sheet transfer mechanism. The ejection mechanism is configured to switch between an ejection process and a duplex recording process relative to a back surface of the recording sheet after completion of the recording process on a front surface of the recording sheet. The second sheet path is configured to receive the recording sheet from the ejection mechanism, when the ejection mechanism switches to the duplex recording process, and to transfer the recording sheet back to the image recording mechanism. The second sheet path is arranged on other sides of the apparatus than the side of the apparatus for the first sheet path. The sheet flipping mechanism is configured to flip the recording sheet in the second sheet path and to have a flipping space in which the recording sheet is flipped without coming outside the apparatus. The sheet flipping mechanism is arranged along the second sheet path.

The first sheet path may be arranged in a front part of the apparatus.

The second sheet path may be arranged in a rear and top part of the apparatus, a rear part of the apparatus, and under the sheet cassette.

The sheet flipping mechanism may be arranged in a rear part of the apparatus.

The sheet flipping mechanism may include a guide plate configured to deflect a leading edge of the recording sheet hung down in the flipping space of the sheet flipping mechanism.

The sheet flipping mechanism may be arranged under the sheet cassettes.

The sheet flipping mechanism may include a sheet flipping roller, a driving roller, and a trailing edge detect sensor. With the above configuration, the sheet flipping roller is configured to be rotated forwardly and backwardly so as to transfer the recording sheet temporarily to the flipping space and then back to the second sheet path. The driving roller is configured to be rotated forwardly and backwardly in synchronism with the sheet flipping roller so as to transfer synchronism with the sheet flipping roller so as to transfer the recording sheet temporarily to the flipping space and then back to the second sheet path. The trailing edge detect sensor is configured to detect a trailing edge of the recording sheet when the recording sheet is transferred out of the second sheet path and into the flipping space. The trailing edge detect sensor is arranged in a position between the sheet flipping roller and the driving roller. When the trailing edge detect sensor detects a trailing edge of the recording sheet, the sheet flipping roller and the driving roller are rotated in a reverse direction to reverse transfer the recording sheet back to the second sheet path.

The sheet flipping mechanism may further include a switch pawl configured to conduct the recording sheet into the flipping space, until the trailing edge detect sensor detects the trailing edge of the recording sheet, and to conduct the recording sheet back to the second sheet path, after the trailing edge detect sensor detects the trailing edge of the recording sheet.

The above-mentioned image forming apparatus further includes a second sheet transfer mechanism configured to transfer the recording sheet. Further, the second sheet path is divided into three portions and is included in each of the ejection mechanism, the sheet flipping mechanism, and the second sheet transfer mechanism.

Each of the ejection mechanism, the sheet flipping mechanism, and the second sheet transfer mechanism may be configured to be a separate add-on unit.

A vertical sheet path portion of the second sheet path may include a door portion and an interior of the apparatus is made accessible when the door portion is opened.

The door portion may have a cover, including one of a pair of guide plates, and an inside plate, including the remaining one of the pair of guide plates. In this configuration, the cover is configured to be opened so that the inside plate is made accessible when the cover is opened.

The inside plate may be configured to be opened so that an interior of the apparatus is made accessible when the cover and the inside plate are opened.

The cover and the inside plate may be mounted on the apparatus with a common shaft.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 2 is a cross-sectional view of a color image forming apparatus according to an embodiment of the present invention;

DETAILED DESCRIPTION OF THE PREFERRED EMBODIMENTS

Figure 1:
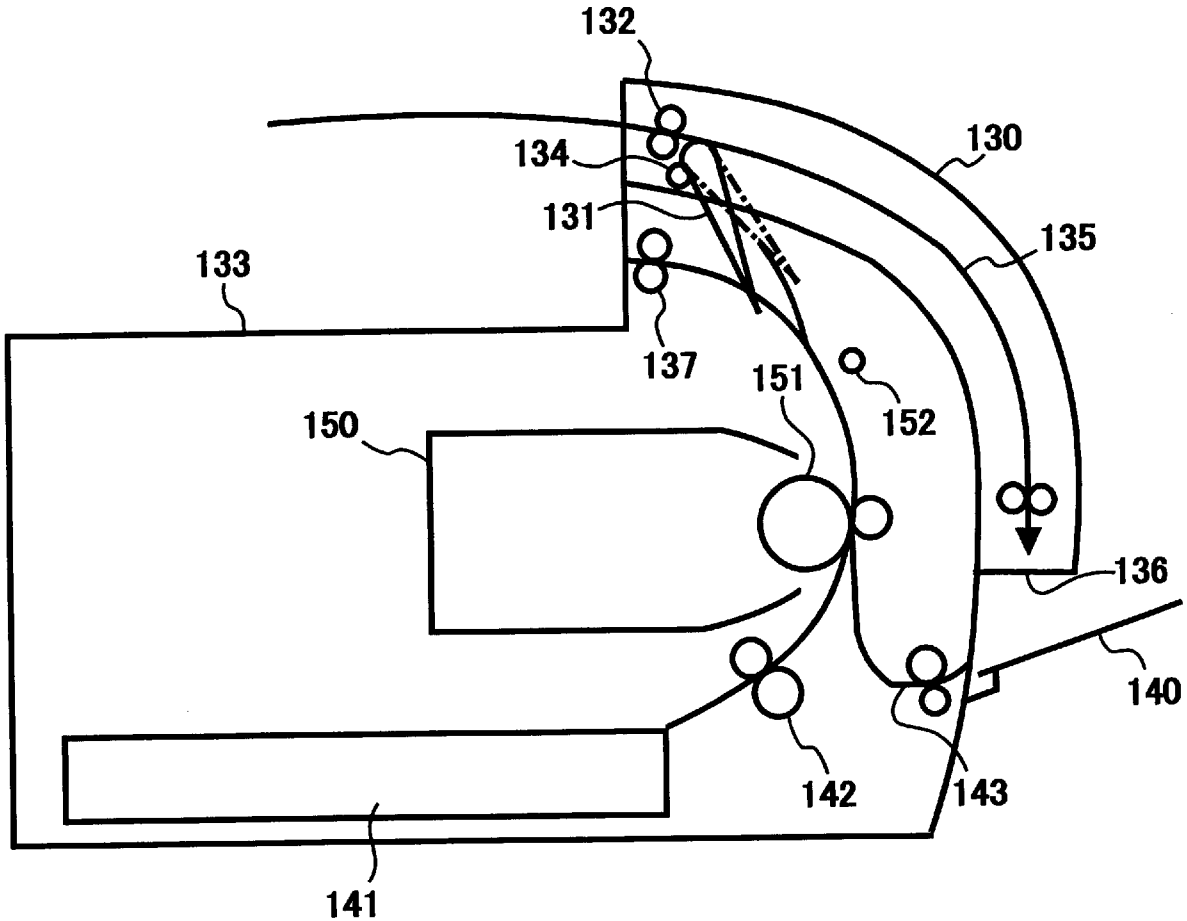
FIG. 1 PRIOR ART
FIG. 1 is a cross-sectional view of a prior art image forming apparatus.

In describing preferred embodiments illustrated in the drawings, specific terminology is employed for the sake of clarity. However, the present invention is not intended to be limited to the specific terminology selected and it is to be understood that each specific element includes all technical equivalents which operate in a similar manner.

Figure 2:
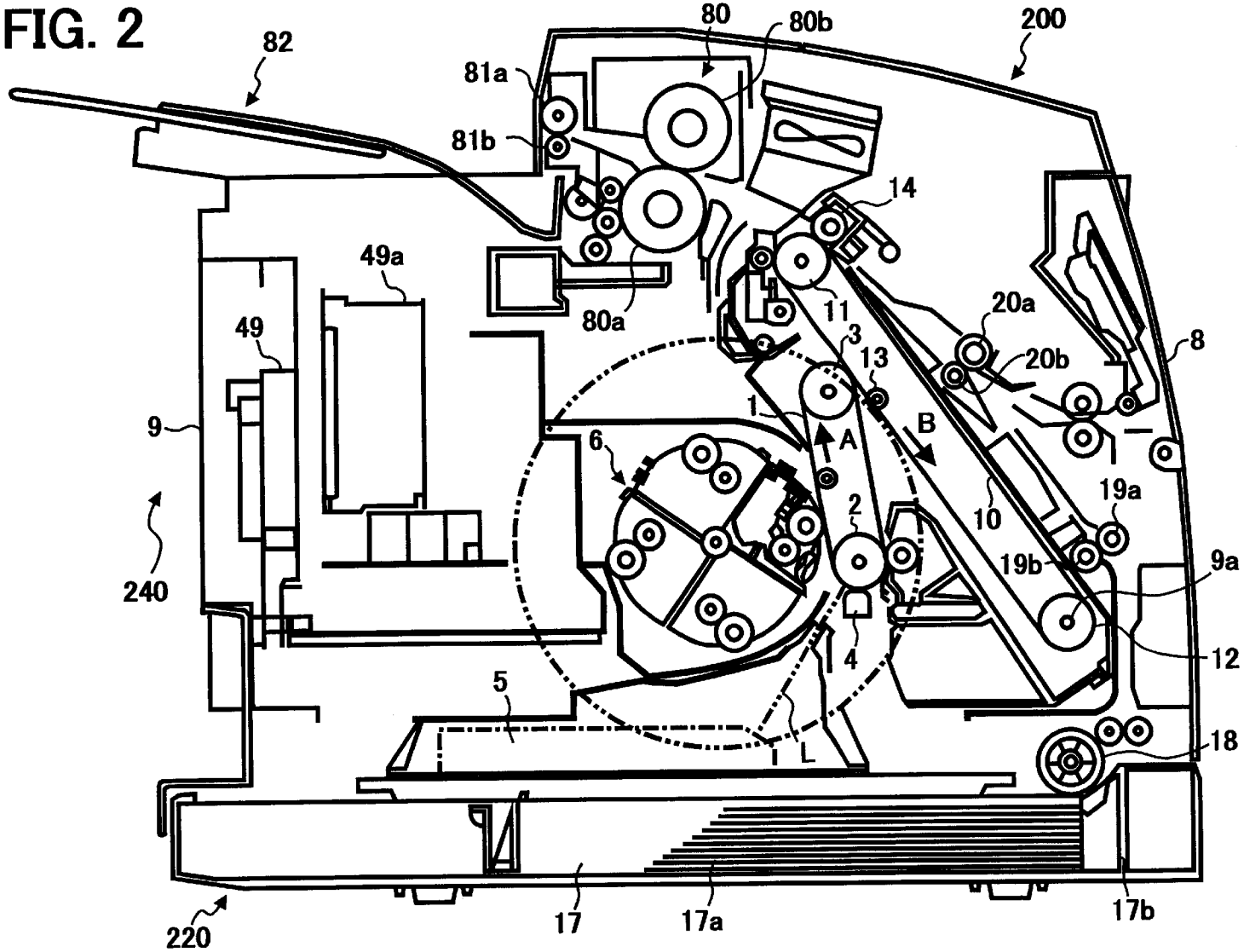
FIG. 2 is a cross-sectional view of an image forming apparatus according to an embodiment the present invention.
Figure 3:
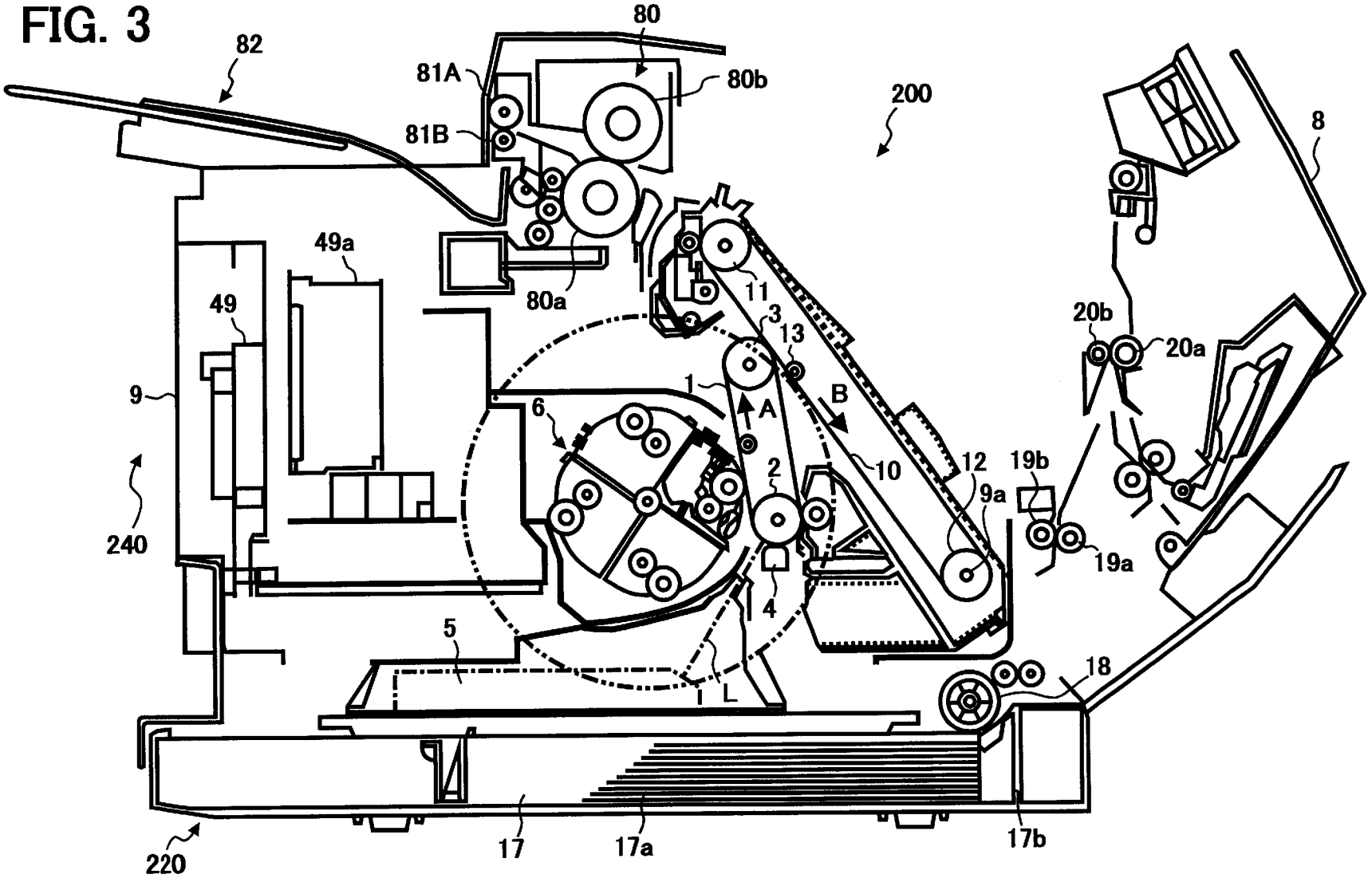
FIG. 3 is a cross-sectional view of the color image forming apparatus of FIG. 2, when a front frame is opened.
Figure 4:
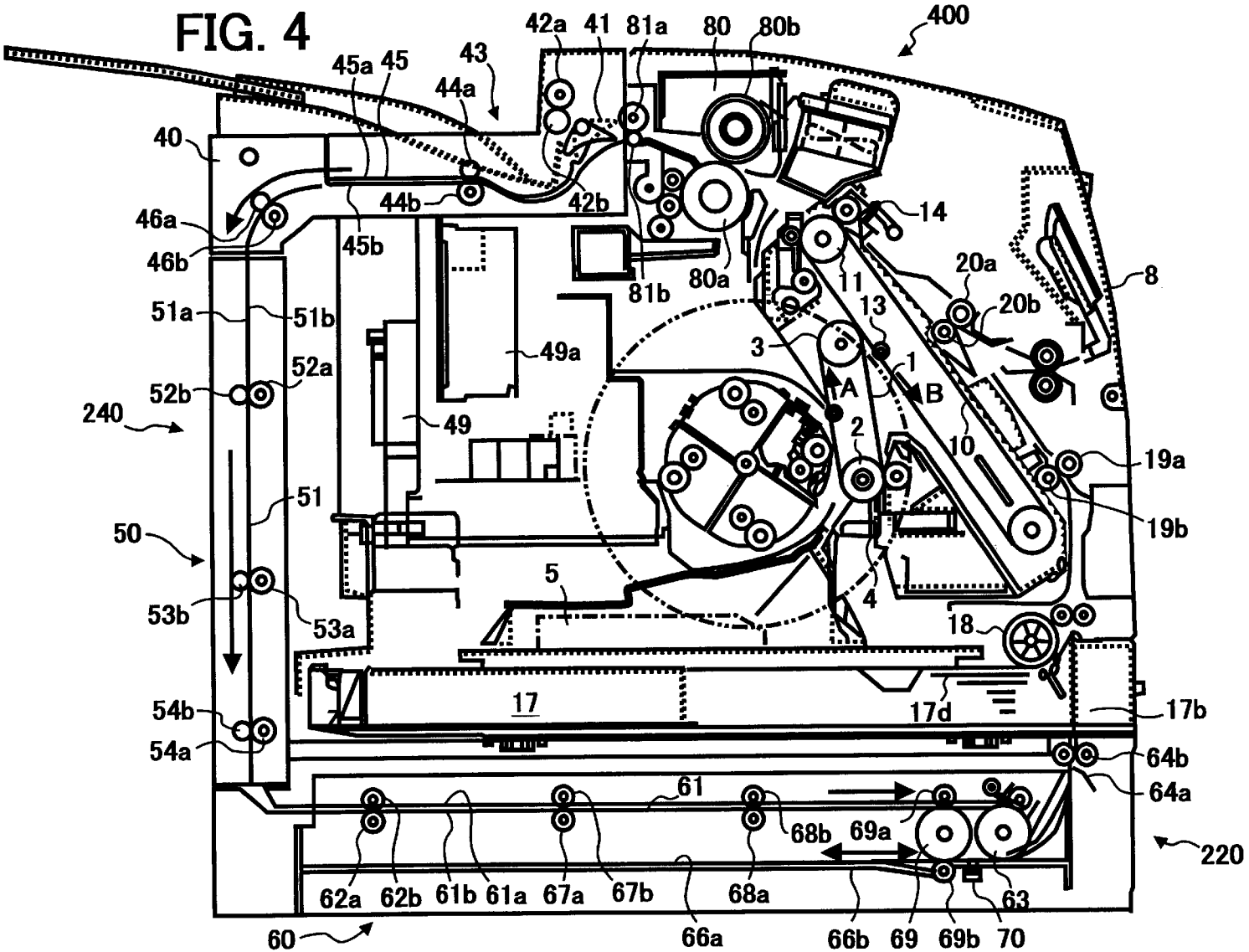
FIG. 4 is a cross-sectional view of a duplex color image forming apparatus, based on the color image forming apparatus of FIG. 2, with an add-on units including an ejection unit, a transfer unit, and a sheet flipping unit.

Referring now to the drawings, wherein like reference numeral designate identical or corresponding parts throughout the several views, and more particularly to FIGS. 2–4, image forming apparatuses, according to an embodiment of the present invention, are described. FIG. 2 shows a cross-sectional view of a color image forming apparatus 200, which has no duplex printing function for reproducing an image on both sides of a recording sheet. FIG. 3 illustrates the color image forming apparatus 200 of FIG. 2 with its front frame opened. FIG. 4 shows a cross-sectional view of a color image forming apparatus 400 provided with a duplex printing function. The color image forming apparatus 400 of FIG. 4 is made by adding an extra ejection unit, an extra transfer unit, and a sheet flipping unit, which are explained later, to the color image forming apparatus 200 of FIG. 2.

As shown in FIG. 2, the color image forming apparatus 200 includes a photoconductive belt 1, a main charger 4, a laser optical unit 5, a developing unit 6, an intermediate transfer belt 10, and a bias roller 13, which are the main components of an image forming mechanism for forming a toner image. The color image forming apparatus 200 further includes a transfer roller 14, serving as a transfer mechanism for transferring a toner image onto a recording sheet. The color image forming apparatus 200 further includes a fixing unit 80 and an ejection tray unit 82. The color image forming apparatus 200 further includes a sheet transport mechanism (not shown), for transporting a recording sheet into a place between the intermediate transfer belt 10 and the transfer roller 14, and to the fixing unit 80, so as to eject it eventually to the ejection tray unit 82. The above components are arranged inside a front frame 8 and a body frame 9, both explained later.

The photoconductive belt 1, serving as an image carrying member, includes a flexional belt and is extended between rollers 2 and 3. By rotation of the roller 2, the photoconductive belt 1 is rotated clockwise as indicated by an arrow A. Under the roller 2, the main charge 4, for evenly charging the surface of the photoconductive belt 1, is deposited. The laser optical unit 5, for performing a laser writing operation, is arranged in a bottom section 220 of the color image forming apparatus 200, and the developing unit 6, including four developing mechanisms, integrated into single units with one containing yellow developing agents or toners, one containing magenta developing agents or toners, one containing cyan developing agents or toners, and one containing black developing agents or toners, is arranged in the bottom section 220.

The intermediate transfer belt 10 is arranged above the photoconductive belt 1 and is extended between the rollers 11 and 12. The intermediate transfer belt 10 is rotated counterclockwise, as indicated by an arrow B, by rotation of the roller 11. The photoconductive belt 1 makes contact with the intermediate transfer belt 10 at a part thereof supported by the roller 3. Around this contact part, the bias roller 13, made of a conductive material, is deposited inside the intermediate transfer belt 10 under certain conditions.

In the thus-configured color image forming apparatus 200, the photoconductive belt 1 is evenly charged with respect to the main charger and is exposed to laser light, emitted in accordance with image information, by the laser optional unit 5. Thereby, an electrostatic latent image is formed on the surface of the photoconductive belt 1. The image information on the laser light is of a mono-color image made by separating a full-colored image into yellow, cyan, magenta, and black color information. A laser beam L, emitted from the laser optical unit 5, carries the above mono-colored image information.

Each electrostatic latent image made in this way is developed with the corresponding color toner by the developing unit 6, which is a revolving type color developing unit, explained in more detail below. That is, yellow, cyan, magenta, and black electrostatic latent images are, in turn, formed and are developed with the yellow, cyan, magenta, and black toners, respectively. Thereby, yellow, cyan, magenta, and black toner images are formed one after another, in this order, on the surface of the photoconductive belt 1.

Each mono-colored toner image thus formed on the photoconductive belt 1 is transferred by a predetermined bias voltage applied to the bias roller 13 onto the surface of the intermediate transfer belt 10, rotated in the direction of the arrow B in synchronism with the rotation of the photoconductive belt 1. Through the above operations, after a yellow toner image formed on the photoconductive belt 1 is transferred onto the intermediate transfer belt 10, a cyan toner image formed on the photoconductive belt 1 is transferred onto the intermediate transfer belt 10 such that the cyan toner image is superimposed on the yellow toner image, resulting in a creation of a yellow-cyan toner image on the intermediate transfer belt 10. After that, a magenta toner image, formed on the photoconductive belt 1, is transferred onto the intermediate transfer belt 10 such that the magenta toner image is superimposed on the yellow-cyan-magenta toner image. As a result, a yellow-cyan-magenta toner image is formed on the intermediate transfer belt 10. Then, a black toner image, formed on the photoconductive belt 1, is transferred onto the intermediate transfer belt 10 such that the black toner image is superimposed on the yellow-cyan-magenta toner image on the intermediate transfer belt 10. Thereby, a yellow-cyan-magenta-black toner image, or a full-colored image, is formed on the intermediate transfer belt 10.

The thus-created full-colored toner image on the intermediate transfer belt 10 is transferred at a time by the transfer roller 14 onto a recording sheet 17*a* sent from a sheet cassette 17 for containing a plurality of the recording sheets 17*a*. The sheet cassette 17 is slidably deposited inside the bottom section 220 and is configured to be drawn out, from the right in FIG. 2, to the side of the front frame 8 towards an operator. A sheet roller 18 is mounted near and above an outlet opening of the sheet cassette 17. The sheet roller 18 picks up and sends out a recording sheet 17*a,* one by one, from the sheet cassette 17. A recording sheet 17*a,* sent from the sheet cassette 17, is moved to the transfer roller 14 via a pair of transfer rollers 19*a* and 18*b,* mounted on the front frame 8, and a pair of registration rollers 20*a* and 20*b,* also mounted on the front frame 8. The transfer roller 14 is also mounted on the front frame 8 so that the transfer roller 14 makes contact, under pressure, with the intermediate transfer belt 10, when the front frame 8 is set at a closing position, at which time the front frame 8 closes a front opening of the color image forming apparatus 200. After completion of the transfer, the recording sheet 17*a* is sent to the fixing unit 80 in which the recording sheet 17*a* is pressurized by a pair of fixing rollers 80*a* and 80*b* so that the toner image on the recording sheet 17*a* is fixed. Then, the recording sheet 17*a* is ejected to the ejection tray unit 82 by a pair of ejection rollers 81*a* and 81*b* arranged in a rear and top area of the color image forming apparatus 200. Thus, a plurality of the recording sheets 17*a* are stacked in the ejection tray unit 82.

A sheet path 17*b* is provided between the sheet cassette 17 and the front frame 8 in order to cause the recording sheet 17*a,* sent from a sheet flipping unit 60, to be explained in more detail below, to pass the transfer rollers 19*a* and 19*b*.

The front frame 8 and the body frame 9 constitute the frame structure of the color image forming apparatus 200. The body frame 9 is fixed in a rear section 240 of the color image forming apparatus 200. The front frame 8 is movable between the above-mentioned closing position and an opening position. The front opening of the color image forming apparatus 200 is closed when the front frame 8 is located at the closing position, but is opened when the front frame 8 is located at the opening position. When the front opening is opened by locating the front frame 8 at the opening position, the sheet path, which is configured between the sheet cassette 17 and the transfer roller 14, is exposed to an outside air and becomes accessible to the operator. Relative to the body frame 9, the sheet cassette 17 is located in a lower part thereof and the developing unit 6 is located in a central part thereof. The fixing unit 80 is located over the developing unit 6, and the ejection tray unit 82 is located above and in the back of the developing unit 6.

The front frame 8 is movably supported to turn about a rotation shaft 9*a* provided on the body frame 9. During a time when an image forming operation is in process, the front frame 8 is held by the body frame 9, as shown in FIG. 2. During a time when a jammed sheet is removed, the front frame 8 can be turned clockwise by being released from the body frame 9 and set at the opening position, as shown in FIG. 3. The front frame 8 is tensioned at the opening position with a tension spring (not shown), for example.

Since the registration rollers 20*a* and 20*b* and the transfer roller 14 are mounted on the front frame 8, as described above, the opening of the transfer path, from the transfer roller 14 to the sheet cassette 17, is made in a more effective manner when the front frame 8 is moved to the opening position, as shown in FIG. 3. Accordingly, the operator can remove a jammed sheet more easily. During such jammed-sheet removal, units associated with the image forming are not in operation and therefore a dispersion of toner would not be caused.

The color image forming apparatus 200 of FIG. 2 further includes an electric component unit 49 containing various electrical components including a control circuit board 49*a* for controlling a sheet flipping control, which will be explained in more detail below.

Referring to FIG. 4, a structure of the color image forming apparatus 400, having the duplex printing function, is explained. In the structure of the color image forming apparatus 400, the color image forming apparatus 200 of FIG. 2 is used as a base unit. The ejection tray unit 82 is removed from the color image forming apparatus 200 and a duplex mechanism, to be explained in more detail below, is then added thereto such that the duplex mechanism receives a recording sheet 17*a* ejected from the ejection rollers 81*a* and 81*b*. Such duplex mechanism is configured to select whether to eject the recording sheet 17*a* or to precede an image reproduction on a backside of the recording sheet 17*a*. As illustrated in FIG. 4, the duplex mechanism of the color image forming apparatus 400 includes a duplex ejection unit 40, a duplex transfer unit 50, and a duplex sheet flipping unit 60. The duplex ejection unit 40 is arranged downstream from the fixing unit 80 in the sheet transfer direction and is located at a rear and top of the color image forming apparatus 400. The duplex transfer unit 50 is arranged in the rear section 240 of the base unit and the duplex sheet flipping unit 60 is arranged in the bottom section 220 of the base unit, wherein the base unit is the color image forming apparatus 200, as described above.

The duplex ejection unit 40 includes a switch pawl 41 for switching the transfer direction of the recording sheet 17*a,* transferred by the ejection rollers 81 and 81*b,* back and forth between to the duplex print process and to the ejection. The duplex ejection unit 40 further includes an ejection tray 43 for stacking the recording sheets 17*a* therein. The duplex ejection unit 40 further includes a pair of ejection rollers 42*a* and 42*b* for ejecting the recording sheet 17*a* to the ejection tray 43, when the recording sheet 17*a,* output from the ejection rollers 81*a* and 81*b,* is conducted by the switch pawl 41 to the ejection site. The duplex ejection unit 40 further includes two pairs of rollers 44*a* and 44*b,* 46*a* and 46*b,* and a pair of guide plates 45*a* and 45*b,* for forwarding the recording sheet 17*a* to the duplex transfer unit 50, when the recording sheet 17*a,* output from the ejection rollers 81*a* and 81*b,* is conducted by the switch pawl 41 to the duplex print process. The two pairs of rollers 44*a* and 44*b,* 46*a* and 46*b,* are arranged along the guide plates 45*a* and 45*b*. Between the guide plates 45*a* and 45*b,* a sheet path 45, for passing the recording sheet 17*a,* is formed.

The duplex transfer unit 50 includes a pair of guide plates 51*a* and 51*b,* for guiding the recording sheet 17*a* sent from the duplex ejection unit 40 to the duplex sheet flipping unit 60. Along the above-mentioned guide plates 51*a* and 51*b,* the duplex transfer unit 50 further includes three pairs of rollers 52*a* and 52*b,* 53*a* and 53*b,* and 54*a* and 54*b* for forwarding the recording sheet 17*a* to the duplex sheet flipping unit 60. Between the guide plates 51*a* and 51*b,* a sheet path 51, for passing the recording sheet 17*a,* is formed.

With the above-described structure, when the recording sheet 17*a* needs to be ejected, the recording sheet 17*a,* transferred by the ejection rollers 81*a* and 82, is guided by the switch pawl 41 to the ejection tray 43 and is stacked therein. Further, when the recording sheet 17*a* needs to be sent to the duplex print process, the recording sheet 17*a,* from the ejection rollers 81*a* and 81*b,* is guided by the switch pawl 41 to the duplex transfer unit 50 via the sheet path 45 of the duplex ejection unit 40. In the duplex transfer unit 50, the recording sheet 17*a* is transferred through the sheet path 51 to the duplex sheet flipping unit 60.

The duplex sheet flipping unit 60 includes a pair of guide plates 61*a* and 61*b,* a sheet flipping roller 63, a pair of guide plates 66*a* and 66*b,* and a driving roller 69. A sheet path 61 is formed between the guide plates 61*a* and 61*b*. The guide plates 61*a* and 61*b* guide the recording sheet 17*a* transferred from the duplex transfer unit 50 to the front frame 8. The sheet flipping roller 63 is mounted on an end of the guide plates 61*a* and 61*b* near the front frame 8. The guide plates 66*a* and 66*b* guide the recording sheet 17*a,* which is flipped by the sheet flipping roller 63. The driving roller 69 is arranged downstream from the sheet flipping roller 63 in the sheet transfer direction and upstream from the sheet flipping roller 63 in the flipped-sheet transfer direction, as illustrated in FIG. 4.

The duplex sheet flipping unit 60 further includes three pair of rollers 62*a* and 62*b,* 67*a* and 67*b,* and 68*a* and 68*b* arranged along the guide plates 61*a* and 61*b*. The duplex sheet flipping unit 60 further includes a pair of drive rollers 69*a* and 69*b* for applying a predetermined pressure to the recording sheet 17*a* against the driving roller 69 and a pair of rollers 64*a* and 64*b* for forwarding the recording sheet 17*a* to the rollers 19*a* and 19*b*. The duplex sheet flipping unit 60 further includes a transfer guide member 65, configured to elastically make contact, under pressure, with the sheet flipping roller 63. With the transfer guide member 65, the recording sheet 17*a* is flipped so as to be transferred to the guide plates 66*a* and 66*b* and is then transferred to the rollers 64*a* and 64*b*. The transfer guide member 65 may be a switch pawl for switching the transfer direction of the recording sheet 17*a*.

The recording sheet 17*a* transferred along the guide plates 61*a* and 61*b* is transferred to the sheet flipping roller 63 with the driving roller 69 and the driven roller 69*a*. Further, the recording sheet 17*a,* held in the guide plates 66*a* and 66*b,* is transferred to the sheet flipping roller 63 with the driving roller 69 and the driven roller 69*b*. The sheet flipping roller 63 and the driving roller 69 are driven to rotate in synchronism with each other.

The duplex sheet flipping unit 60 further includes a trailing edge detect sensor 70, to be explained in more detail below.

With the thus-structured duplex sheet flipping unit 60, the recording sheet 17*a,* transferred via the duplex transfer unit 50, is transferred, through the guide plates 61*a* and 61*b,* between the driving roller 69 and the driving roller 69*a,* and the sheet flipping roller 63, to the front side, or the operator side. Then, the recording sheet 17*a* is forwarded to the guide plates 66*a* and 66*b* by the transfer guide member 65 and the sheet flipping roller 63. Upon a trailing edge of the recording sheet 17*a* being detected by the trailing edge detect sensor 70, after the trailing edge of the recording sheet 17*a* passes by the transfer guide member 65, the sheet flipping roller 63 and the driving roller 69 are driven in the reverse direction. Thereby, the recording sheet 17*a* is transferred in the reverse direction to the rollers 64*a* and 64*b* and, therefore, the trailing and leading edges of the recording sheet 17*a* are changed. Thus, the recording sheet 17*a* is forwarded through the sheet path 17*b* to the rollers 19*a* and 19*b,* and then to the registration rollers 20*a* and 20*b*. After that, the recording sheet 17*a* is subjected to the image forming process so that a full-colored toner image is transferred and fixed onto the other surface of the recording sheet 17*a*. The recording sheet 17*a,* having images on both sides, is then ejected to the ejection tray 43.

Figure 5:
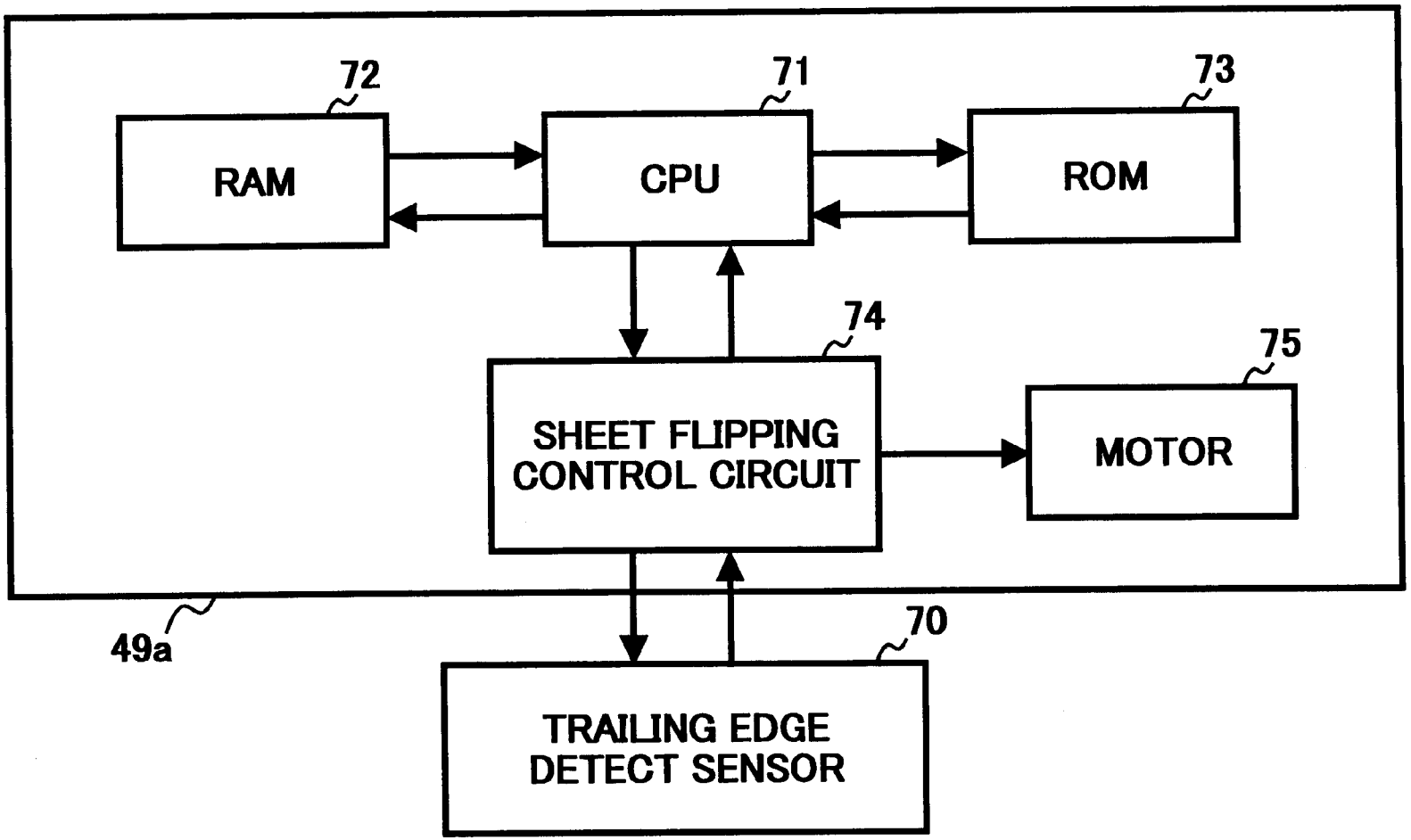
FIG. 5 is a schematic block diagram of a control circuit board of the color image forming apparatus of FIG. 2.

Referring to FIG. 5, an exemplary configuration of the control circuit board 49*a,* for performing the sheet flipping control, is explained. The control circuit board 49*a* includes a CPU (central processing unit) 71, a RAM (random access memory) 72, a ROM (read only memory) 73, a sheet flipping control circuit 74, and a motor 75. The CPU 71 executes programs stored in the ROM 73 using static data stored in the ROM 73 and dynamic data stored in the RAM 72 with a working area reserved in the RAM 72. The sheet flipping control circuit 74 is connected to the trailing edge detect sensor 70, mounted in the duplex sheet flipping unit 60, so as to send a driving signal to, and to receive a detect signal from, the trailing edge detect sensor 70. The sheet flipping control circuit 74 sends the above-described detect signal, output from the trailing edge detect sensor 70, to the CPU 71. The CPU 71 generates a control signal for controlling the motor 75 (i.e., a start, a stop, a reverse) based on the detect signal.

Thus, the color image forming apparatus 400 includes the duplex mechanism, wherein the duplex ejection unit 40 is attached on the rear and top thereof, the duplex transfer unit 50 is attached in the rear section 240, and the duplex sheet flipping unit 60 is attached in the bottom section 220. Even with the above-described duplex mechanism, however, the front frame 8 can be turned to the closing or opening position so that the sheet path, formed between the sheet cassette 17 and the transfer roller 14, is exposed to an outside air and becomes accessible to the operator. In addition, with this configuration, no modification is required to the internal structure of the color image forming apparatus 200, which is used as a base. That is, the simplex color image forming apparatus 200 can easily be upgraded to the duplex color image forming apparatus 400. It may also be possible to easily change the duplex color image forming apparatus 400 to the simplex color image forming apparatus 200.

With the above configuration, the recording sheet 17*a* is not brought to an outside of the color image forming apparatus 400 during the transportation after the first image reproduction is completed. Therefore, there is no risk of sheet jamming, even if the operator wrongly touches the recording sheet 17*a* when it comes out from the machine during the transportation after the first image reproduction.

Figure 6:
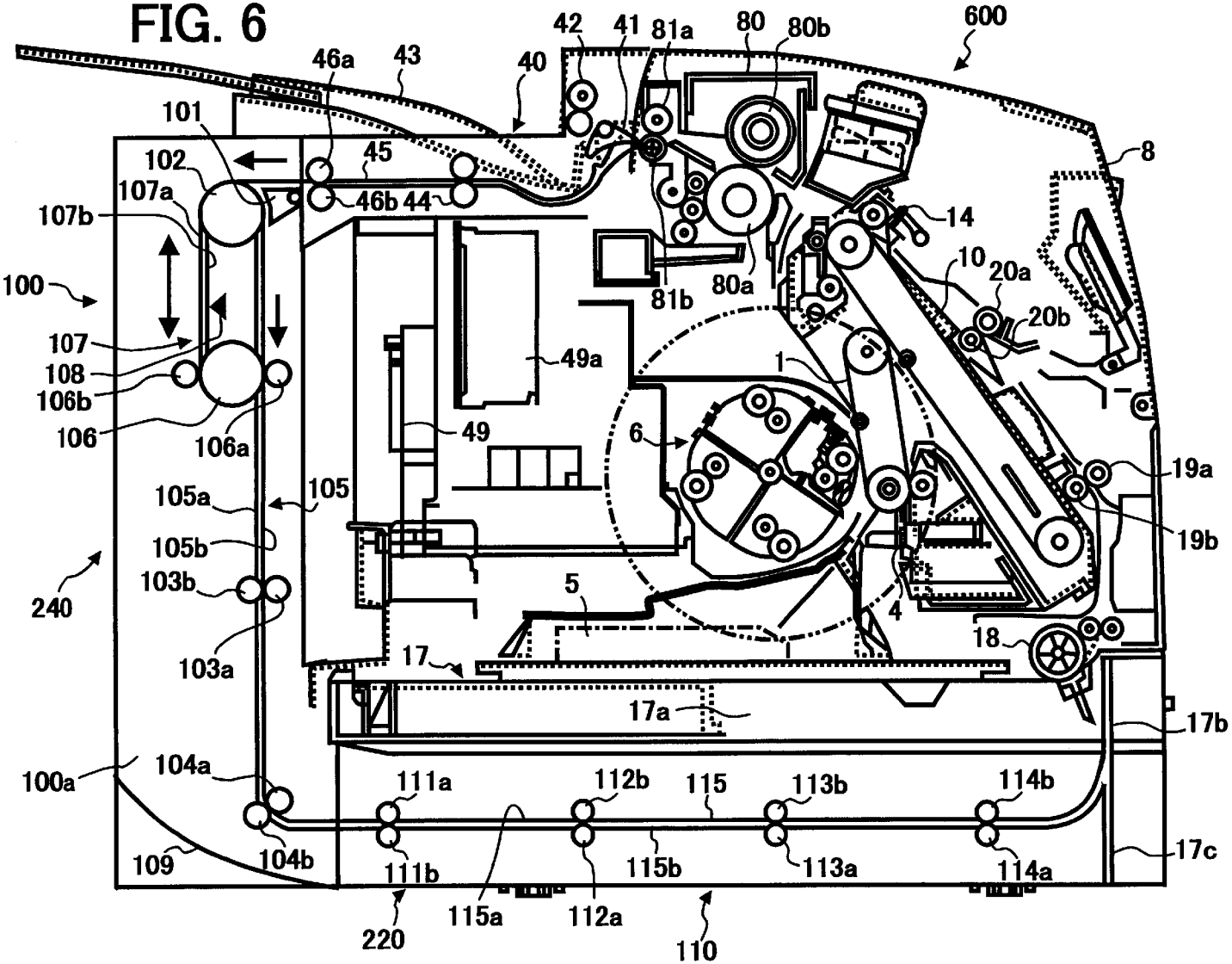
FIG. 6 is a cross-sectional view of another duplex color image forming apparatus according to an embodiment of the present invention.

Referring to FIG. 6, a color image forming apparatus 600, according to another embodiment of the present invention, is explained. The color image forming apparatus 600 of FIG. 6 is similar to the color image forming apparatus 400 of FIG. 4, except for a duplex sheet flipping unit 100 and a duplex transfer unit 110. That is, the structure of the color image forming apparatus 600 is such that the color image forming apparatus 200 of FIG. 2 is used as a base unit and a duplex mechanism, to be explained in further detail below, is added. Further, the duplex sheet flipping unit and the duplex transfer unit are mounted in different manners. That is, in the color image forming apparatus 600, the duplex sheet flipping unit 100 is arranged in the rear section 240 of the base unit and the duplex transfer unit 110 is arranged in the bottom section 220 of the base unit, wherein the base unit is the color image forming apparatus 200, as described above.

The duplex sheet flipping unit 100 includes a switch pawl 101, a sheet flipping roller 102, a pair of guide plates 105*a* and 105*b,* a sheet path 105, guide plates 107*a* and 107*b,* and a driving roller 106. The switch pawl 101 switches the transfer direction of the recording sheet 17*a* passed through the transfer rollers 46*a* and 46*b* of the duplex ejection unit 40. The sheet flipping roller 102 is rotated both in the forward and reverse directions. The guide plates 105*a* and 105*b* form the sheet path 105 therebetween so as to guide the recording sheet 17*a,* coming from the sheet flipping roller 102 to the duplex transfer unit 110, through the sheet path 105. The guide plates 107*a* and 107*b* form a sheet flipping path. The driving roller 106 is arranged downstream from the sheet flipping roller 102 in the sheet transfer direction.

The duplex sheet flipping unit 100 further includes pairs of rollers 103*a* and 103*b,* 104*a* and 104*b* along the guide plates 105*a* and 105*b* and a trailing edge detect sensor 108 deposited about midway of the guide plates 107*a* and 107*b*. The trailing edge detect sensor 108 is equivalent to the trailing edge detect sensor 70 and is used by the sheet flipping control circuit 74 of the control circuit board 49*a* in a manner similar to that in the color image forming apparatus 400.

In the configuration of the color image forming apparatus 600, the recording sheet 17*a* hangs down from the driving roller 106 during the sheet flipping process in a space 100*a* of the duplex sheet flipping unit 100. Therefore, the duplex sheet flipping unit 100 is provided at the bottom thereof with a curbed guide plate 109 so that, if the recording sheet 17*a* is of a relatively large size, the leading edge of the sheet 17*a* can be guided to the side of the duplex transfer unit 110. Thereby, the recording sheet 17*a* of a relatively large size is prevented from generating wrinkles during the time when it hangs down from the driving roller 106 in the space 100*a*.

The duplex sheet flipping unit 100 further includes a pair of rollers 106*a* and 106*b* making contact under a predetermined pressure with the driving roller 106. The roller 106*a* is mounted near the guide plates 105*a* and 105*b* and the roller 106*b* is mounted near the guide plates 107*a* and 107*b*.

The sheet flipping roller 102 and the driving roller 106 are driven to rotate in synchronism with each other.

The duplex transfer unit 110 includes a pair of guide plates 115*a* and 115*b* for guiding the recording sheet 17*a* sent from the duplex sheet flipping unit 100 and a sheet path 115 formed between the guide plates 115*a* and 115*b*. Along the guide plates 115*a* and 115*b*, the duplex transfer unit 110 further includes four pairs of rollers 111*a* and 111*b*, 112*a* and 112*b*, 113*a* and 113*b*, and 114*a* and 114*b*. The sheet path 115 is connected at a first end to the sheet path 105 of the duplex sheet flipping unit 100 and at a second end to the sheet path 17*b* of the base unit.

It is possible to install another unit of the sheet cassette 17 under the duplex transfer unit 110. For this purpose, the duplex transfer unit 110 includes a sheet path 17*c* which is connected at the upper end to the sheet path 17*b* of the base unit and at the bottom end to the outside. With such a sheet path 17*c*, a recording sheet 17*a*, from the second sheet cassette 17, is transferred to the transfer rollers 19*a* and 19*b*.

With the above configuration of the color image forming apparatus 600, the recording sheet 17*a*, transferred by the rollers 46*a* and 46*b* of the duplex ejection unit 40 after the image reproduction on one surface of the recording sheet 17*a*, is moved in the following manner. At this time, the switch pawl 101 is positioned, as illustrated in FIG. 6, so that the recording sheet 17*a* is transferred to a grip of the driving roller 106 and the roller 106*b*, via the sheet flipping roller 102 and a sheet flipping path 107 formed between the guide plates 107*a* and 107*b*. When the trailing edge of the recording sheet 17*a* passes by the trailing edge detect sensor 108, the switch pawl 101 is moved clockwise to the other position so as to close a passage to the sheet flipping path 107 from the rollers 46*a* and 46*b* of the duplex election unit 40. At this time, the sheet flipping roller 102 and the driving roller 106 are switched to rotate respectively in the reverse direction so that the recording sheet 17*a* is started to be transferred in the reverse direction, wherein the leading edge and the trailing edge of the recording sheet 17*a* are swapped with each other. That is, the recording sheet 17*a* is returned to the switch pawl 101 and is guided by the switch pawl 101 to the sheet path 105, via a grip of the driving roller 106 and the roller 106*a*. Then, the recording sheet 17*a* passes by the rollers 104*a* and 104*b* and enters into the duplex transfer unit 110, wherein the recording sheet 17*a* is further transferred through the sheet path 115 by the four pairs of rollers 111*a* and 111*b*, 112*a* and 112*b*, 113*a* and 113*b*, and 114*a* and 114*b*. After the rollers 114*a* and 114*b*, the recording sheet 17*a* is forwarded to the rollers 19*a* and 19*b* via the sheet path 17*b* of the base unit. The recording sheet 17*a* is then subjected to the second reproduction through the base unit. Finally, the recording sheet 17*a*, which is reproduced on both surfaces, is ejected to the ejection tray 43.

In the thus-configured color image forming apparatus 600, it is not necessary to provide more than one sheet path (i.e., the sheet path 115) to the duplex transfer unit 110 and therefore, the duplex transfer unit 110 can be made smaller in height than the duplex transfer unit 60 of the color image forming apparatus 400.

In addition, in the color image forming apparatus 600, the duplex sheet flipping unit 100 is relatively large, particularly in width, but it would not effect an entire length of the color image forming apparatus 600, since an extension part of the ejection tray 43 is relatively long, as illustrated in FIG. 6.

Figure 7:
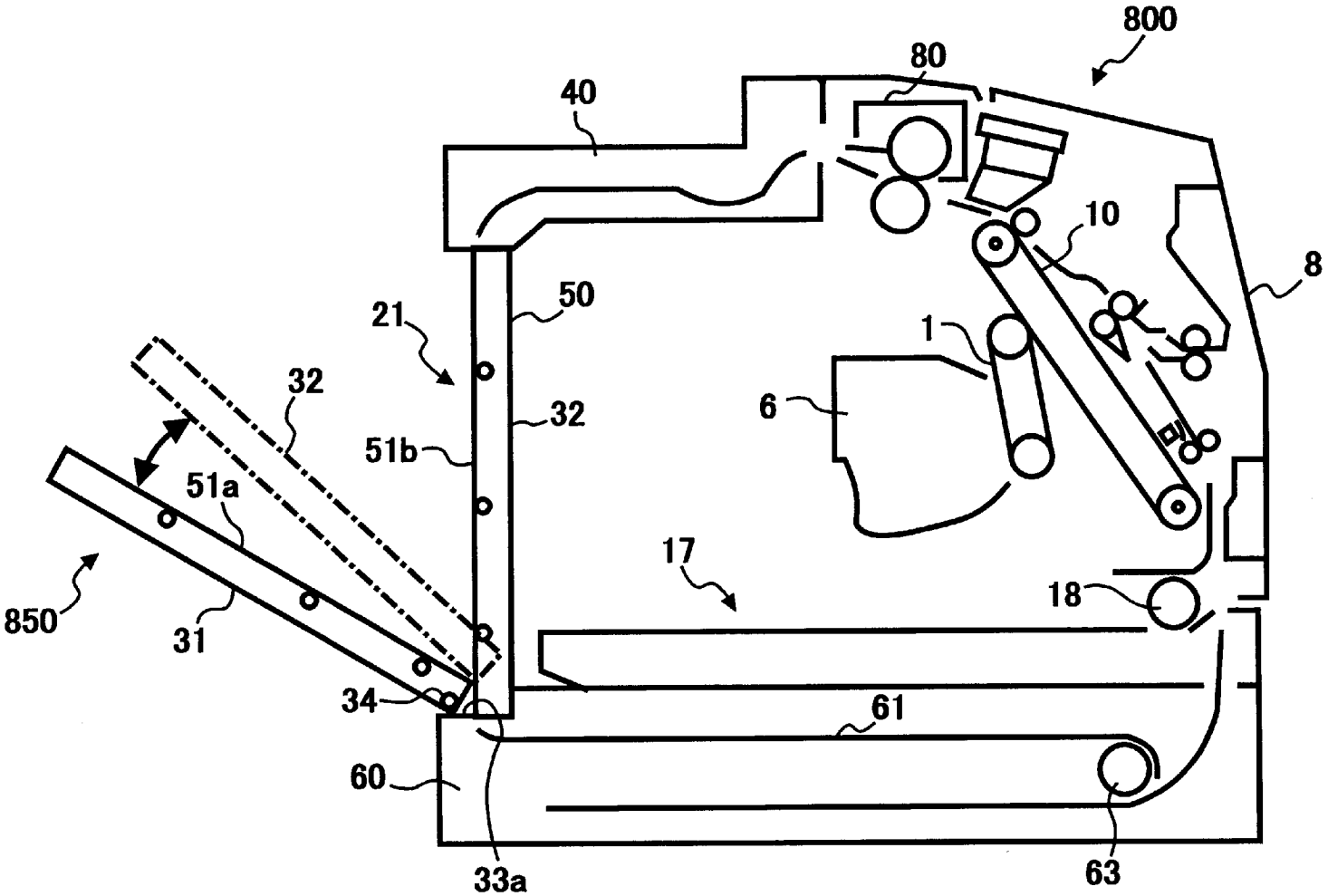
FIGS. 7 and 8 are cross-sectional views of another color image forming apparatus, based on the color image forming apparatus of FIG. 2.
Figure 8:
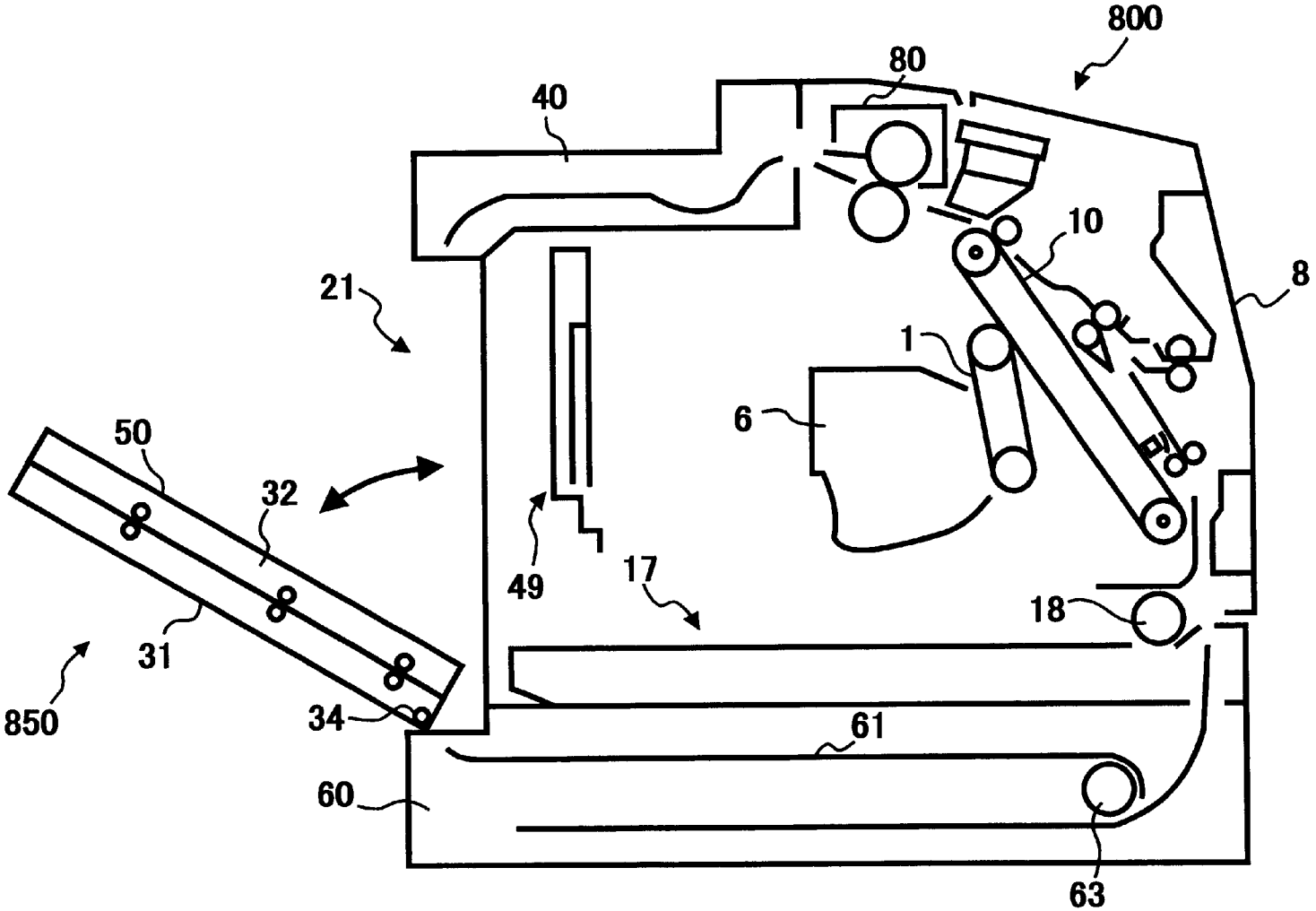

Referring to FIGS. 7 and 8, a color image forming apparatus 800, according to another embodiment of the present invention, is explained. The color image forming apparatus 800, of FIGS. 7 and 8, is similar to the color image forming apparatus 200 of FIG. 2, except for a duplex transfer unit 850.

The duplex transfer unit 850 includes a vertical transfer mechanism 21. The vertical transfer mechanism 21 includes a cover 31 having the guide plate 51*a*, rollers 52*b*, 53*b*, and 54*b*, and an inside plate 32 including the guide plate 51*b* and the rollers 52*a*, 53*a*, and 54*a*. The duplex transfer unit 850 further includes a shaft 34, arranged at a bottom area 33*a* of an opening 33 formed in the rear section 240 of the base unit. The cover 31 is configured to be turned about the shaft 34 so as to expose the surface of the inside plate 32 to the outside air. In this example, a simple mechanism (i.e., a magnet), for holding the cover 31 at the closing position, is employed, in order for the operator to be able to access the surface of the inside plate 32, for example, to remove the sheet jam.

With the above configuration, the color image forming apparatus 800 provides easy and simple accessibility to inside surface of the duplex transfer unit.

In addition, the inside plate 32 may be configured to be turned about the shaft 34, as indicated by phantom lines in FIG. 7. Thereby, an interior of the base unit is opened and is made accessible to the operator. For example, when an additional memory, which is a user installable item, is installed by the operator, the operator can easily access the control circuit board 49*a*, for example, by opening the cover 31 and the inside plate 32, as illustrated in FIG. 8. The inside plate 32 is held to the base unit with a simple mechanism such as a screw (not shown), easily loosened by, for example, a coin. In other words, the inside plate 32 is normally closed and, when necessary, the operator can easily open it with a coin.

With the above configuration, the color image forming apparatus 800 provides easy and simple accessibility to the interior of the base unit.

Numerous additional modifications and variations of the present application are possible in light of the above teachings. It is therefore to be understood that within the scope of the appended claims, the present application may be practiced otherwise than as specifically described herein.

What is claimed as new and desired to be secured by letters patent of the United States is:

1. An image forming apparatus, comprising:

a sheet cassette configured to contain a plurality of recording sheets, said sheet cassette being located at a lower part of said image forming apparatus;

a first sheet path arranged in a first side of said image forming apparatus;

a first sheet transfer mechanism configured to send each of said plurality of recording sheets, one by one, from said sheet cassette through said first sheet path;

an image recording mechanism configured to perform an image recording process relative to each of said plurality of recording sheets sent by said first sheet transfer mechanism;

an ejection mechanism configured to switch between an ejection process and a duplex recording process relative to a back surface of each of said plurality of recording sheets, after completion of said recording process on a front surface of each of said plurality of recording sheets;

a second sheet path configured to receive each of said plurality of recording sheets from said ejection mechanism, when said ejection mechanism switches to said duplex recording process and to transfer each of said plurality of recording sheets back to said image recording mechanism, said second sheet path being arranged in sides of said image forming apparatus other than said first side of said apparatus in which said first sheet path is arranged;

a sheet flipping mechanism configured to flip each of said plurality of recording sheets in said second sheet path and to have a flipping space in which each of said plurality of recording sheets are flipped, without coming outside said image forming apparatus, and said sheet flipping mechanism being arranged along said second sheet path; and a second sheet transfer mechanism configured to transfer each of said plurality of recording sheets, wherein each of said ejection mechanism, said sheet flipping mechanism, and said second sheet transfer mechanism is configured to be a separate add-on unit.

2. The image forming apparatus as defined in claim 1, wherein said first sheet path is arranged in a front part of said image forming apparatus.

3. The image forming apparatus as defined in claim 2, wherein said second sheet path is arranged in all of a top part of said image forming apparatus, a rear part of said image forming apparatus, and under said sheet cassette.

4. The image forming apparatus as defined in claim 1, wherein said sheet flipping mechanism is arranged in a rear part of said image forming apparatus.

5. The image forming apparatus as defined in claim 4, wherein said sheet flipping mechanism includes a guide plate configured to deflect a leading edge of each of said plurality of recording sheets, when each of said plurality of recording sheets hang downwardly in said flipping space of said sheet flipping mechanism.

6. The image forming apparatus as defined in claim 1, wherein said sheet flipping mechanism is arranged under said sheet cassette.

7. The image forming apparatus as defined in claim 1, wherein said sheet flipping mechanism includes:

a sheet flipping roller configured to be rotated forwardly and backwardly so as to transfer each of said plurality of recording sheets temporarily to said flipping space and then back to said second sheet path;

a driving roller configured to be rotated forwardly and backwardly in synchronism with said sheet flipping roller so as to transfer each of said plurality of recording sheets temporarily to said flipping space and then back to said second sheet path; and a trailing edge detect sensor configured to detect a trailing edge of each of said plurality of recording sheets, when each of said plurality of recording sheets is transferred out of said second sheet path and into said flipping space, said trailing edge detect sensor being arranged in a position between said sheet flipping roller and said driving roller, when said trailing edge detect sensor detects said trailing edge of each of said plurality of recording sheets, said sheet flipping roller and said driving roller being rotated in a reverse direction to reverse transfer said recording sheet back to said second sheet path.

8. The image forming apparatus as defined in claim 7, wherein said sheet flipping mechanism further comprises a switch pawl, configured to conduct each of said plurality of recording sheets into said flipping space until said trailing edge detect sensor detects said trailing edge of each of said plurality of recording sheets, and configured to conduct each of said plurality of recording sheets back to said second sheet path after said trailing edge detect sensor detects said trailing edge of each of said plurality of recording sheets.

9. The image forming apparatus as defined in claim 1, wherein said second sheet path is divided into three portions and is included in each of said ejection mechanism, said sheet flipping mechanism, and said second sheet transfer mechanism.

10. The image forming apparatus as defined in claim 1, wherein a vertical sheet path portion of said second sheet path includes a door portion, and wherein an interior of said image forming apparatus is made accessible when said door portion is opened.

11. The image forming apparatus as defined in claim 10, wherein said door portion includes a cover, said cover including a first of a pair of guide plates and an inside plate, said inside plate including a second of said pair of guide plates, and said cover being configured to be opened so that said inside plate is made accessible when said cover is opened.

12. The image forming apparatus as defined in claim 11, wherein said inside plate is configured to be opened so that an interior of said image forming apparatus is made accessible when said cover and said inside plate are opened.

13. The image forming apparatus as defined in claim 11, wherein said cover and said inside plate are mounted to said image forming apparatus about a common shaft.

14. An image forming apparatus, comprising:

sheet containing means for containing a plurality of recording sheets, said sheet containing means being located at a lower part of said image forming apparatus;

first sheet path means arranged in a first side of said image forming apparatus;

first sheet transferring means for sending each of said plurality of recording sheets, one by one, from said sheet containing means through said first sheet path means;

image recording means for performing an image recording process relative to each of said plurality of recording sheets sent by said first sheet transferring means;

ejecting means for switching between an ejection process and a duplex recording process relative to a back surface of each of said plurality of recording sheets, after completion of said image recording process on a front surface of each of said plurality of recording sheets;

second sheet path means for receiving each of said plurality of recording sheets from said ejecting means, when said ejecting means switches to said duplex recording process, and said second sheet path means for transferring each of said plurality of recording sheets back to said image recording means, said second sheet path means being arranged in sides of said image forming apparatus other than said first side of said image forming apparatus in which said first sheet path means is arranged; and sheet flipping means for flipping each of said plurality of recording sheets in said second sheet path means, said sheet flipping means having a flipping space in which each of said plurality of recording sheets is flipped, without coming outside said image forming apparatus, and said sheet flipping means being arranged along said second sheet path means; and second sheet transfer means for transferring each of said plurality of recording sheets, wherein each of said ejection means, said sheet flipping means, and said second sheet transfer means is configured to be a separate add-on unit.

15. The image forming apparatus as defined in claim 14, wherein said first sheet path means is arranged in a front part of said image forming apparatus.

16. The image forming apparatus as defined in claim 15, wherein said second sheet path means is arranged in all of a top part of said image forming apparatus, a rear part of said image forming apparatus, and under said sheet containing means.

17. The image forming apparatus as defined in claim 14, wherein said sheet flipping means is arranged in a rear part of said image forming apparatus.

18. The image forming apparatus as defined in claim 17, wherein said sheet flipping means includes a guide plate means for deflecting a leading edge of each of said plurality of recording sheets hanging downwardly in said flipping space of said sheet flipping means.

19. The image forming apparatus as defined in claim 14, wherein said sheet flipping means is arranged under said sheet containing means.

20. The image forming apparatus as defined in claim 14, wherein said sheet flipping means include:

sheet flipping roller means for being rotated forwardly and backwardly so as to transfer each of said plurality of recording sheets temporarily to said flipping space and then back to said second sheet path means;

driving roller means for being rotated forwardly and backwardly in synchronism with said sheet flipping roller means so as to transfer each of said plurality of recording sheets temporarily to said flipping space and then back to said second sheet path means; and trailing edge detect sensing means for detecting a trailing edge of each of said plurality of recording sheets, when each of said plurality of recording sheets is transferred out of said second sheet path means and into said flipping space, said trailing edge detect sensing means being arranged in a position between said sheet flipping roller means and said driving roller means, when said trailing edge detect sensing means detects said trailing edge of each of said plurality of recording sheets, said sheet flipping roller means and said driving roller means being rotated in a reverse direction to reverse transfer each of said plurality of recording sheets back to said second sheet path means.

21. The image forming apparatus as defined in claim 20, wherein said sheet flipping means further comprises switch pawl means, for conducting each of said plurality of recording sheets into said flipping space until said trailing edge detect sensing means detects said trailing edge of each of said plurality of recording sheets, and for conducting each of said plurality of recording sheets back to said second sheet path means after said trailing edge detect sensing means detects said trailing edge of each of said plurality of recording sheets.

22. The image forming apparatus as defined in claim 14, wherein said second sheet path means is divided into three portions and is included in each of said ejection means, said sheet flipping means, and said second sheet transfer means.

23. The image forming apparatus as defined in claim 14, wherein a vertical sheet path portion of said second sheet path means includes a door portion and an interior, such that said image forming apparatus is made accessible when said door portion is opened.

24. The image forming apparatus as defined in claim 23, wherein said door portion includes a cover, said cover including a first of a pair of guide plates and an inside plate, said inside plate including a second of said pair of guide plates, and said cover being configured to be opened so that said inside plate is made accessible when said cover is opened.

25. The image forming apparatus as defined in clam 24, wherein said inside plate is configured to be opened so that an interior of said image forming apparatus is made accessible when said cover and said inside plate are opened.

26. The image forming apparatus as defined in claim 24, wherein said cover and said inside plate are mounted on said image forming apparatus about a common shaft.

27. An image forming apparatus, comprising:

a sheet cassette configured to contain a plurality of recording sheets, said sheet cassette being locate d at a lower part of said image forming apparatus;

a first sheet path arranged in a first side of said image forming apparatus;

a first sheet transfer mechanism configured to send each of said plurality of recording sheets, one by one, from said sheet cassette through said first sheet path;

an image recording mechanism configured to perform an image recording process relative to each of said plurality of recording sheets sent by said first sheet transfer mechanism;

an ejection mechanism configured to switch between an ejection process and a duplex recording process relative to a back surface of each of said plurality of recording sheets, after completion of said recording process on a front surface of each of said plurality of recording sheets;

a second sheet path configured to receive each of said plurality of recording sheets from said ejection mechanism, when said ejection mechanism switches to said duplex recording process and to transfer each of said plurality of recording sheets back to said image recording mechanism, said second sheet path being arranged in sides of said image forming apparatus other than said first side of said apparatus in which said first sheet path is arranged, said second sheet path being operator accessible for any one of removal of a jammed sheet or maintenance through an open/close cover mechanism provided in a rear of said image forming apparatus, said open/close cover mechanism including first and second side guides forming said second sheet path, said first and second side guides being openable and closable so as to access said second sheet path and an inside of said image forming apparatus, respectively; and a sheet flipping mechanism configured to flip each of said plurality of recording sheets in said second sheet path and to have a flipping space in which each of said plurality of recording sheets are flipped, without coming outside said image forming apparatus, said sheet flipping mechanism being arranged along said second sheet path.

28. An image forming apparatus, comprising:

sheet containing means for containing a plurality of recording sheets, said sheet containing means being located at a lower part of said image forming apparatus;

first sheet path means arranged in a first side of said image forming apparatus;

first sheet transferring means for sending each of said plurality of recording sheets, one by one, from said sheet containing means through said first sheet path means;

image recording means for performing an image recording process relative to each of said plurality of recording sheets sent by said first sheet transferring means;

ejecting means for switching between an ejection process and a duplex recording process relative to a back surface of each of said plurality of recording sheets, after completion of said image recording process on a front surface of each of said plurality of recording sheets;

second sheet path means for receiving each of said plurality of recording sheets from said ejecting means, when said ejecting means switches to said duplex recording process, and said second sheet path means for transferring each of said plurality of recording sheets back to said image recording means, said second sheet path means being arranged in sides of said image forming apparatus other than said first side of said image forming apparatus in which said first sheet path means is arranged, said second sheet path means being operator accessible for any one of removal of a jammed sheet or maintenance through an open/close cover means provided in a rear of said image forming apparatus, said open/close cover mechanism including first and second side guides forming said second sheet path means, said first and second side guides being openable and closable so as to access said second sheet path means and an inside of said image forming apparatus, respectively; and sheet flipping means for flipping each of said plurality of recording sheets in said second sheet path means, said sheet flipping means having a flipping space in which each of said plurality of recording sheets is flipped, without coming outside said image forming apparatus, said sheet flipping means being arranged along said second sheet path means.

* * * * *